US005975958A

United States Patent [19]

Weidler

[11] Patent Number: 5,975,958

[45] Date of Patent: Nov. 2, 1999

[54] CAPACITIVE COUPLING ADAPTER FOR AN ELECTRICAL CONNECTOR

[75] Inventor: Charles Harry Weidler, Lancaster, Pa.

[73] Assignee: The Whitaker Corporation, Wilmington, Del.

[21] Appl. No.: 09/047,748

[22] Filed: Mar. 24, 1998

Related U.S. Application Data

[63] Continuation-in-part of application No. 08/949,668, Oct. 14, 1997.

[51] Int. Cl.[6] ..... H01R 13/66

[52] U.S. Cl. ..... 439/620; 439/939

[58] Field of Search ..... 439/620, 92, 607, 439/939; 333/181; 77/185

[56] References Cited

U.S. PATENT DOCUMENTS

| | | | |
|---|---|---|---|
| 4,500,159 | 2/1985 | Briones et al. | 339/147 R |
| 4,772,221 | 9/1988 | Kozlof | 439/549 |
| 4,797,120 | 1/1989 | Ulery | 439/578 |
| 4,884,982 | 12/1989 | Fleming et al. | 439/620 |
| 4,934,960 | 6/1990 | Capp et al. | 439/620 |
| 4,992,061 | 2/1991 | Brush, Jr. et al. | 439/620 |
| 5,018,989 | 5/1991 | Black et al. | 439/620 |
| 5,062,811 | 11/1991 | Hackman | 439/620 |
| 5,147,224 | 9/1992 | Tan et al. | 439/620 |
| 5,151,054 | 9/1992 | Briones et al. | 439/620 |
| 5,152,699 | 10/1992 | Pfeifer | 439/620 |
| 5,213,522 | 5/1993 | Kojima | 439/620 |
| 5,221,215 | 6/1993 | Tan et al. | 439/620 |
| 5,246,389 | 9/1993 | Briones | 439/620 |
| 5,326,280 | 7/1994 | Briones et al. | 439/581 |
| 5,401,192 | 3/1995 | Briones et al. | 439/639 |
| 5,562,499 | 10/1996 | Minich | 439/620 |
| 5,769,666 | 6/1998 | Wu | 439/620 |
| 5,797,770 | 8/1998 | Davis et al. | 439/607 |
| 5,851,122 | 12/1998 | Huber et al. | 439/620 |

*Primary Examiner*—Khiem Nguyen
*Assistant Examiner*—Michael C. Zarroli
*Attorney, Agent, or Firm*—Bradley N. Ditty

[57] ABSTRACT

Capacitive coupling adapter (40) associated with a shielded electrical connector (12) and including at least one capacitive subassembly (54). Each capacitive subassembly (54) includes a capacitor (46) and a pair of contacts (50,52) engaged with respective electrodes thereof. One contact section (68) of a contact (52) extends from a surface (58) of the adapter housing (42) to engage a shell of a connector (12), and one contact section (64) of a contact (50) extends from an outer surface of housing (42) to engage a cutout peripheral surface (14) of a conductive panel (16) when the adapter/connector (40,12) is mounted in the cutout. The connector shell (22) is thus capacitively coupled to the panel.

10 Claims, 10 Drawing Sheets

CAPACTIVE COUPLING ADAPTER FOR AN ELECTRICAL CONNECTOR

RELATED APPLICATION INFORMATION

This is a Continuation-in-Part of U.S. patent application Ser. No. 08/949,668 filed Oct. 14, 1997.

FIELD OF THE INVENTION

The invention relates to an electrical connector, and more particularly to a connector that is capacitively coupled to the chassis of an electronic device.

BACKGROUND OF THE INVENTION

Electronic devices such as computers and peripheral equipment generally have at least one onboard electrical connector that serves as an input/output (I/O) port for the device. The I/O connector typically has a shield or shell that is grounded to the chassis of the electronic device for protecting the device against electromagnetic interference and against electrostatic discharge when the device is interconnected with another device by an interconnect cable. However, one of the devices to be connected may be at an elevated ground potential with respect to the other device. Therefore, the devices need to be protected against low frequency current that would flow therebetween due to the unequal ground potential during mating and unmating of the interconnect cable. Each device can be protected by a capacitive coupling between the I/O connector and the chassis of the device that would block passage of low frequency current.

In U.S. patent application Ser. No. 08/949,668 filed Oct. 14, 1997 and assigned to the assignee hereof, there is disclosed a capacitive coupling assembly for an electrical connector, where the connector comprises a dielectric housing holding a plurality of contacts and a conductive shell on the housing. The capacitive coupling assembly is electrically coupled to the shell, and comprises a dielectric member that is sandwiched between conductive sheets, the dielectric member holding a plurality of capacitors that are operably connected to effect a capacitance between the conductive sheets, to block low frequency current from electrical potential between the connector shell and a conductive panel to which the connector is to be mounted, at a cutout thereof. One of the conductive sheets engages the panel and first electrodes of the capacitors, and the other conductive sheet engages the connector shell and second electrodes of the capacitors. Both conductive sheets selfsecure to the dielectric member.

It is desired to provide for capacitive coupling of an existing connector with only minimal modifications thereto.

SUMMARY OF THE INVENTION

The present invention provides a capacitive coupling adapter that is affixable to an electrical connector that is to be mounted to a conductive panel at a cutout thereof. A housing of insulative material contains at least one capacitive subassembly, and preferably a plurality of such subassemblies, in a pocket or seat of the housing. The housing is then assembled to a shielded connector, such as having a large aperture through which a shroud of the shield is disposed. A pair of contacts is electrically connected to the capacitor, one contact to each electrode, to define a subassembly, that is then positioned into a respective pocket or seat of the housing. One of the contacts includes a contact section such as a spring arm extending from the seat outwardly beyond an outer side surface of the housing to engage a surface of the panel cutout periphery; the other contact includes a contact section such as a spring arm extending from the seat to electrically engage the connector shield, such as by projecting into the large aperture to engage the shroud. The connector shield is thus capacitively coupled to the conductive panel.

Embodiments of the capacitive coupling adapter will now be described by way of example with reference to the accompanying drawings.

DETAILED DESCRIPTION OF THE EMBODIMENTS

Figure 1:
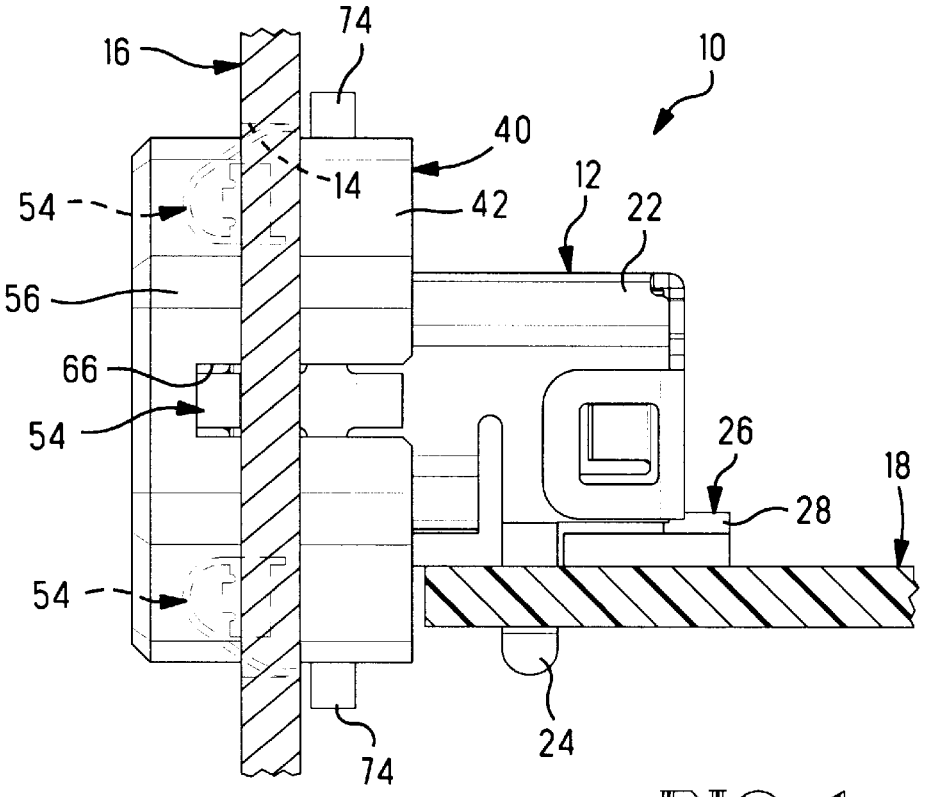
FIGS. 1 and 2 are side elevation views of a shielded surface-mount connector with the adapter of the present invention, mounted to and unmounted from a conductive panel, respectively.
Figure 2:
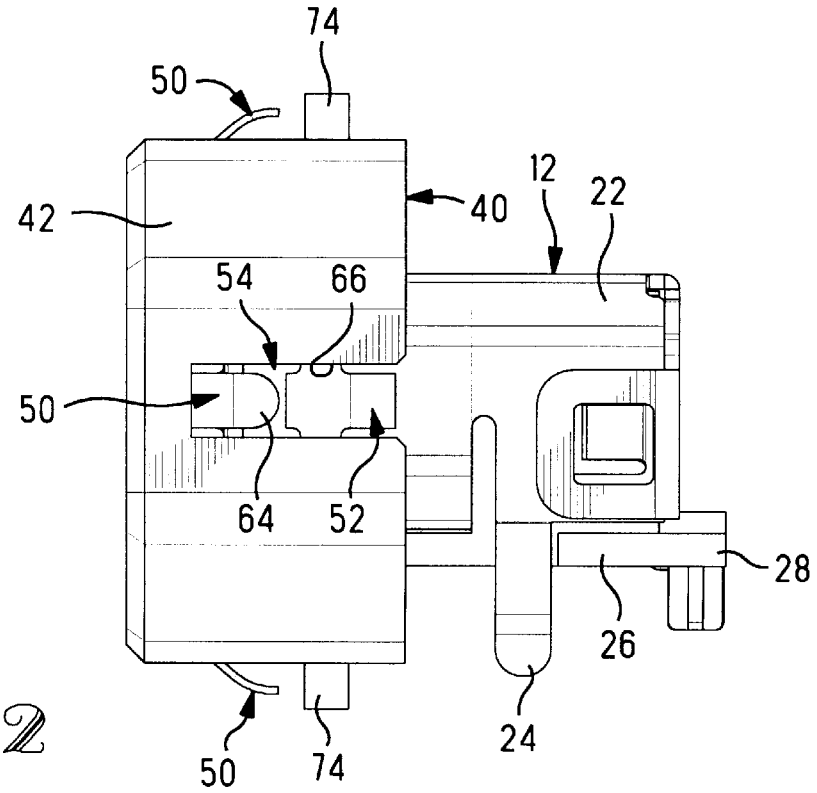

Assembly 10 includes a capacitive coupler adapter 40 and a shielded connector 12, and is mountable in an electronic apparatus (not shown) at an input/output port defined by a cutout 14 through a conductive panel 16 of the apparatus. Connector 12 is shown in FIG. 1 mounted onto a circuit board 18 by surface-mounting techniques; contacts 20 (FIG.4) of the connector are electrically connected to circuits of the board, and the conductive shell 22 of the connector is electrically connected to ground circuits of the board by legs 24. Insulative housing 26 of the connector includes standoff/locating sections 28 that cooperate with circuit board 18 to stabilize the connector in position to protect the solder terminations of the contacts to the board circuits. As shown illustratively herein, connector 12 is of the type known as an IEEE 1394 connector sold by AMP Incorporated, Harrisburg, Pa.

Figure 3:
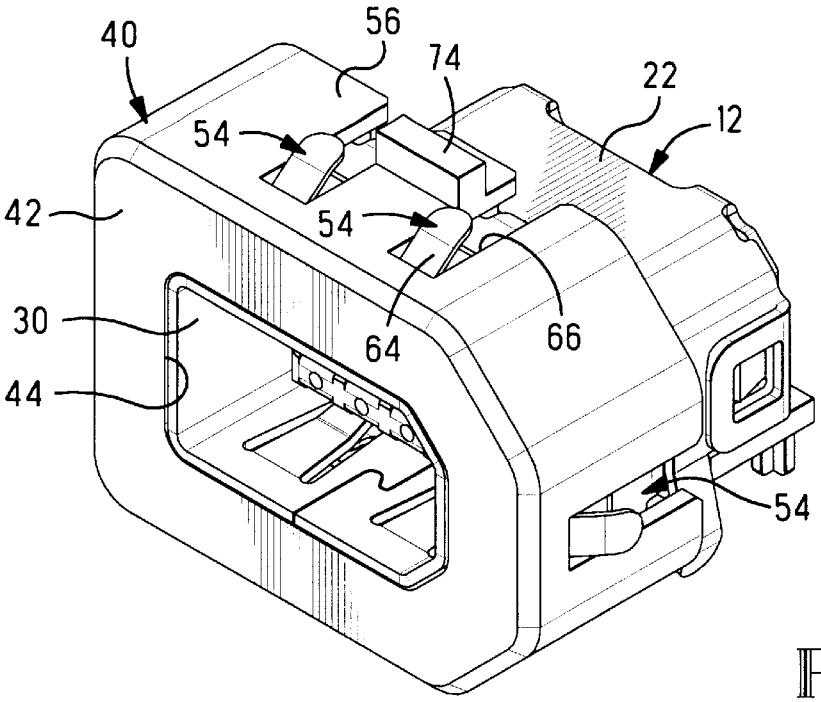
FIGS. 3 and 4 are front and rear isometric views of the connector assembly of FIGS. 1 and 2.
Figure 8:
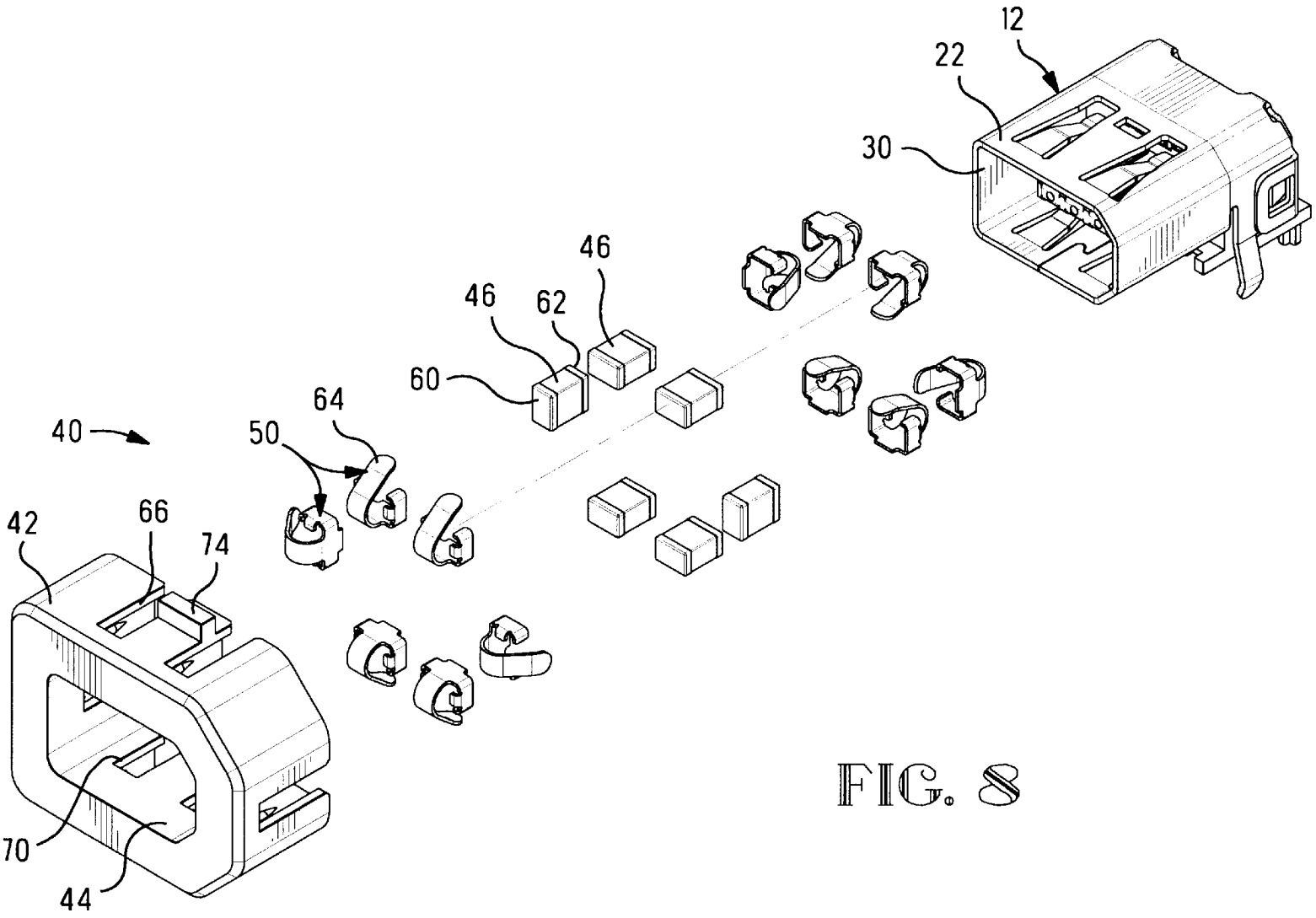
FIG. 8 is an isometric view of the connector of FIGS. 1 to 7 with the components of the adapter exploded therefrom.

Adapter 40 includes an insulative housing 42 having a connector-receiving aperture 44 therethrough, and includes at least one and preferably a plurality of capacitors 46 (FIG. 8) secured in respective recesses or seats 48 (FIGS. 4 and 10) in housing 42. A shroud portion 30 of connector shell 22 extends through aperture 44 (see FIG. 3) for receipt thereinto of a mating plug connector (not shown) inserted through panel cutout 14. Best seen in FIGS. 8 and 13, associated with each capacitor 46 is a pair of contacts 50,52 also positioned in a respective seat 48, the capacitor and its pair of contacts are termed herein a capacitor subassembly 54.

Each capacitor subassembly 54 extends from an outer side surface 56 of housing 42 to an inner aperture surface 58 such that a contact 50 will electrically connect a first electrode 60 with a peripheral edge surface 32 of panel cutout 14 of panel 16, and contact 52 will electrically connect a second electrode 62 with conductive shell 22 of connector 12 thus interposing capacitor 46 in series between the conductive panel and the conductive shell for capacitive coupling. A first contact section such as a spring arm 64 of first contact 50 protrudes outwardly through an opening 66 of housing 42 extending to outer side surface 56 to engage the panel (FIG. 16); a second contact section such as a spring arm 68 of second contact 52 protrudes inwardly through an opening 70 extending to aperture 44 and beyond inner aperture second surface 58 to engage connector shell 22. Bosses 74 of housing 42 protrude outwardly from outer side surface 56 at several locations to provide stops that would abut panel 14 to prevent overinsertion of assembly 10 through panel cutout 14, helping to assuring the appropriate location of spring arms 64 with cutout surface 32.

Figure 4:
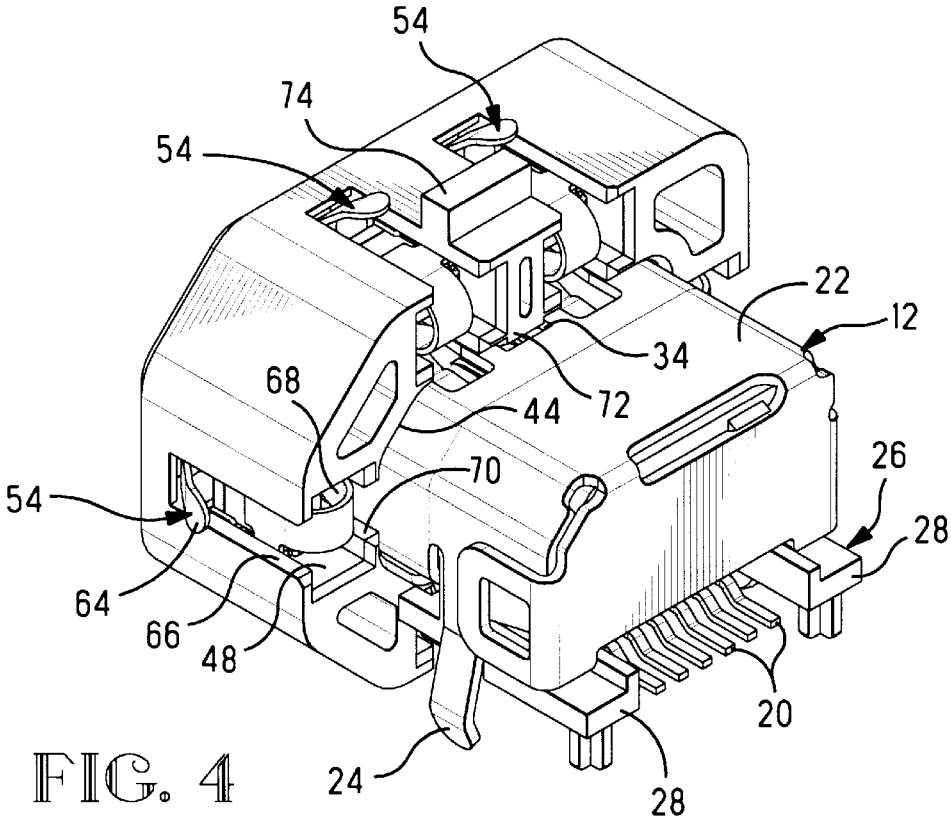
Figure 5:
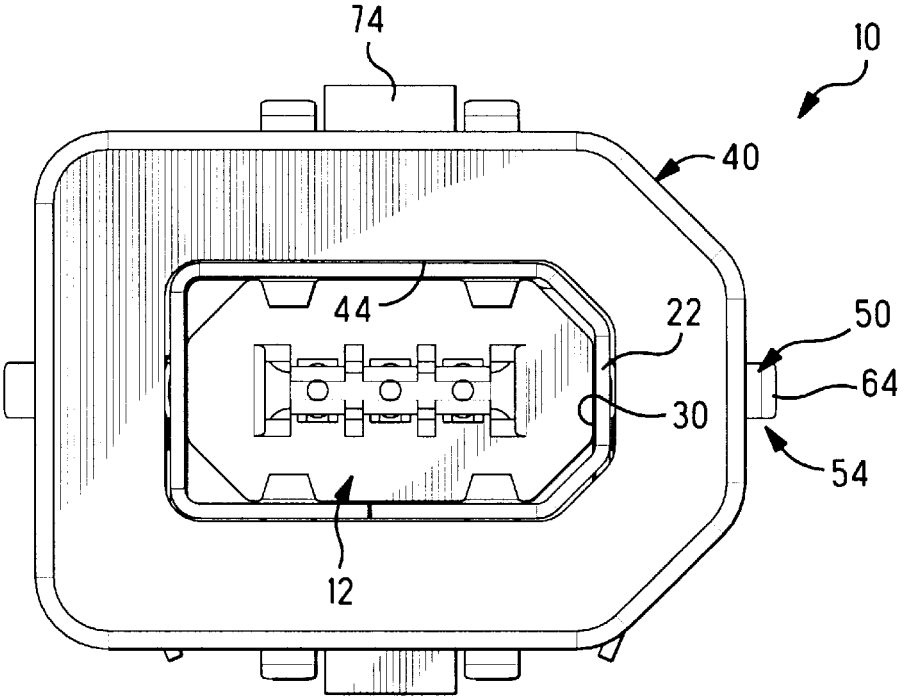
FIGS. 5 to 7 are front elevation, rear elevation and top views of the connector assembly of FIGS. 1 to 4.
Figure 6:
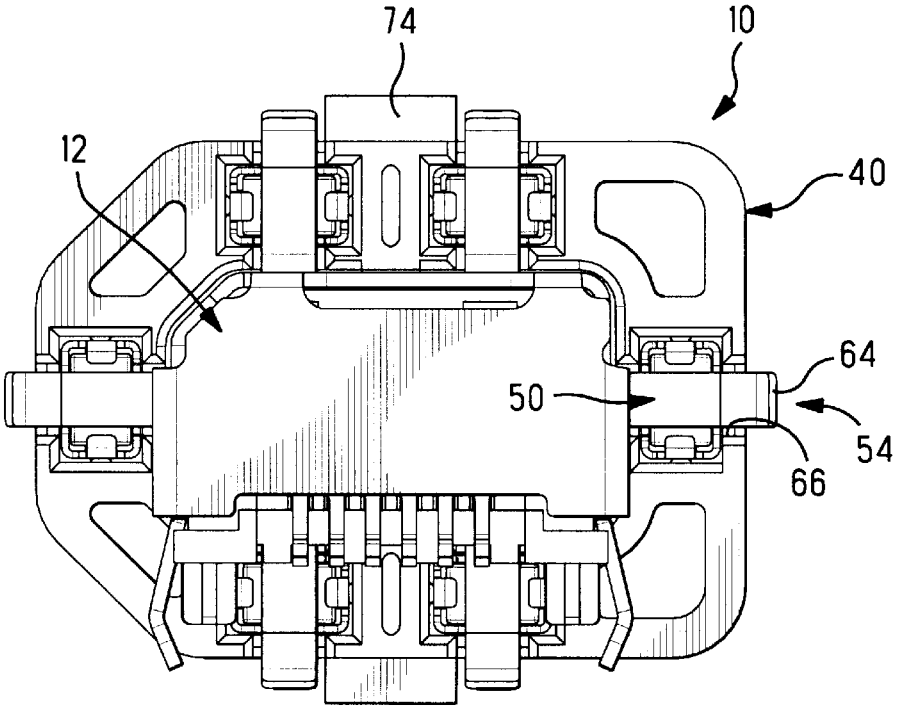
Figure 7:
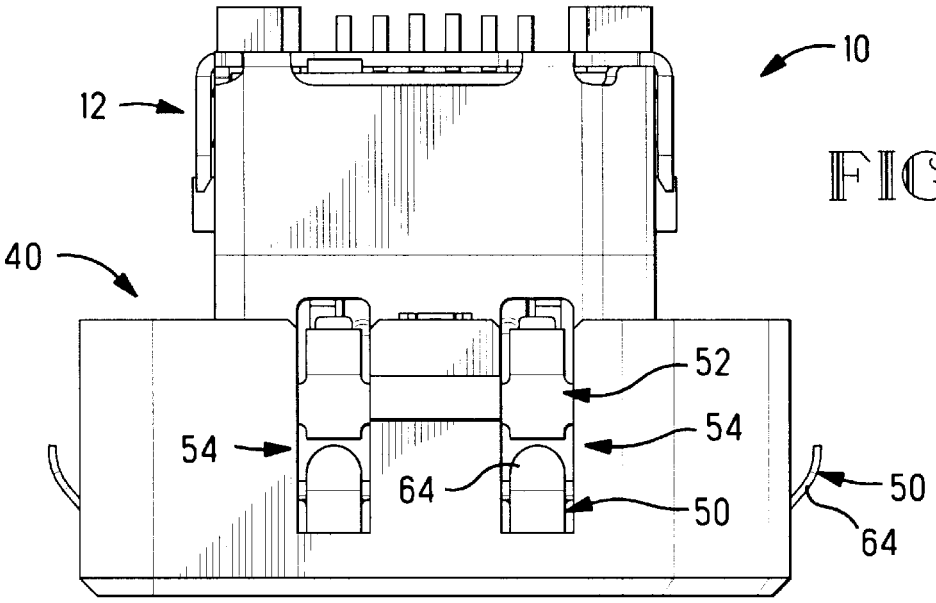
Figure 9:
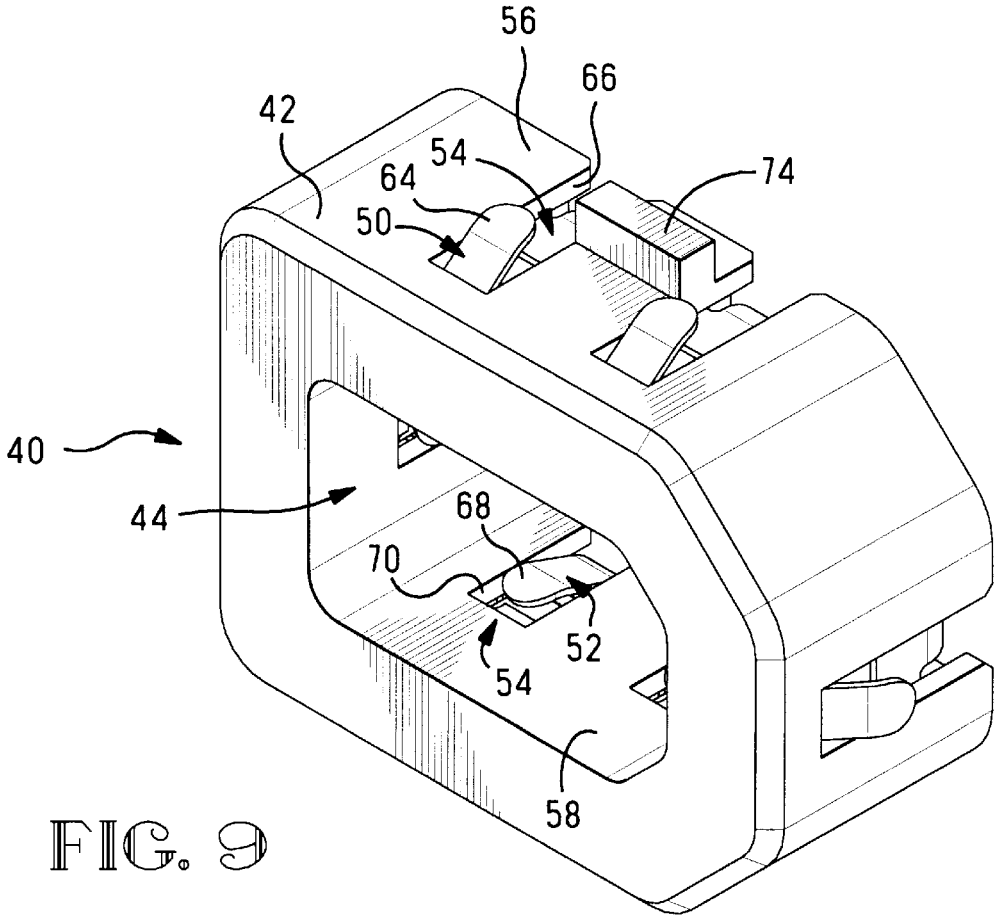
FIG. 9 is a front isometric view of the adapter assembly.
Figure 10:
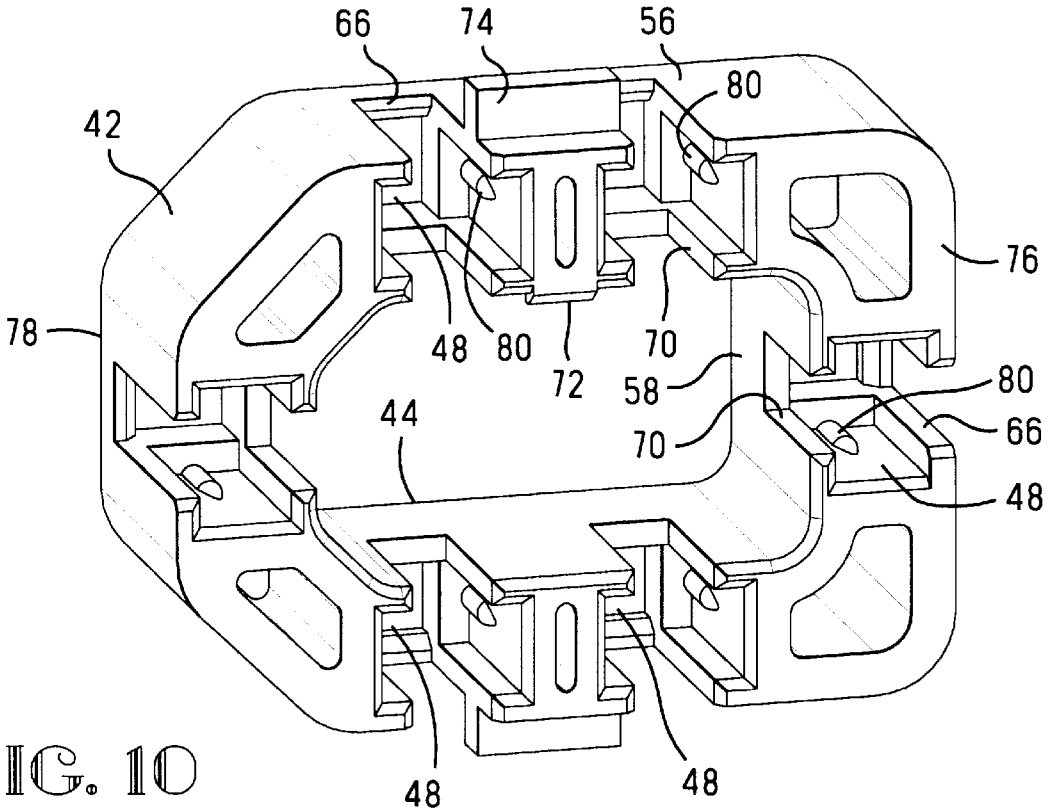
FIG. 10 is a rear isometric view of the adapter housing.
Figure 11:
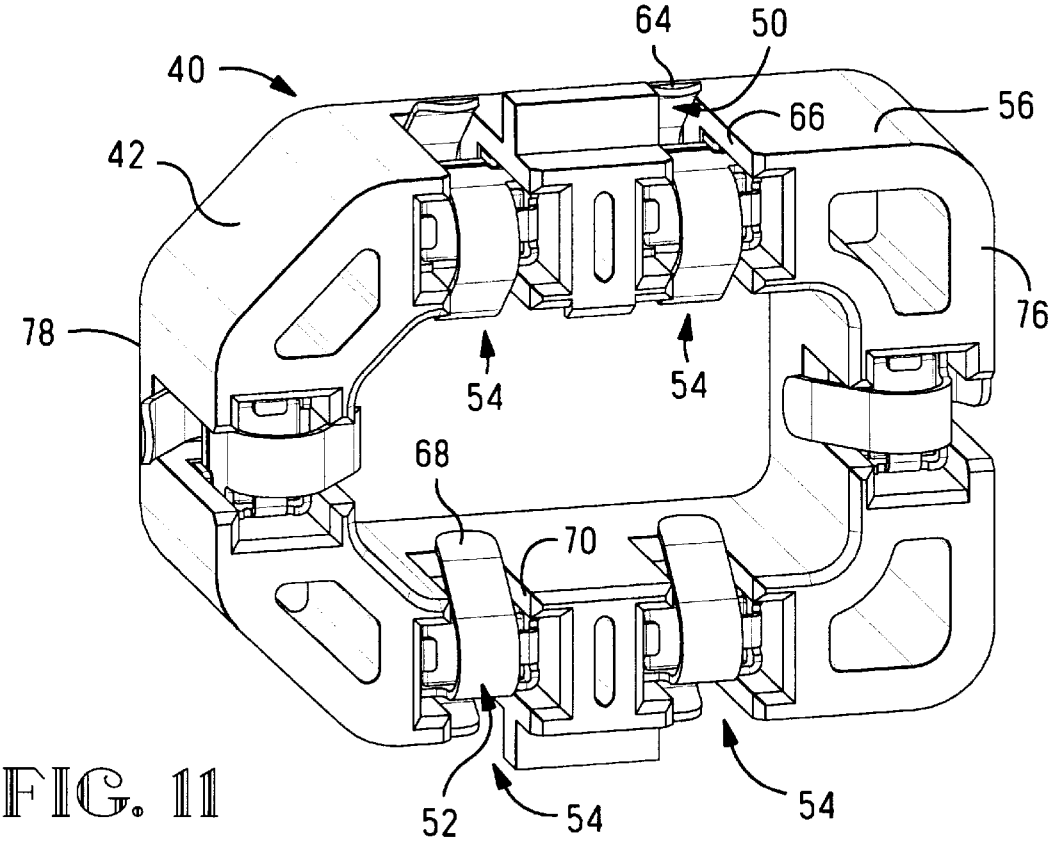
FIG. 11 is a rear isometric view of the adapter assembly.

Housing 42 of adapter 40 is best shown in FIG. 10. Connector-receiving aperture 44 extends from rear face 76 to front face 78, and seats 48 for capacitive subassemblies 54 open onto rear face 76 to permit insertion from rear face 76. Correspondingly, openings 66,70 extend forwardly from rear face 76 to facilitate insertion of the subassemblies. Entrances to seats 48 preferably are provided with chamfered surfaces to facilitate insertion. A latch projection 72 (FIG. 10) protrudes slightly into aperture 44, and becomes latched in a latch recess 34 in connector shell 22 upon assembly, as seen in FIG. 4, for retention of adapter 40 to connector 12. Optionally, adhesive may be utilized to facilitate maintaining adapter 40 affixed to connector 12.

Figure 12:
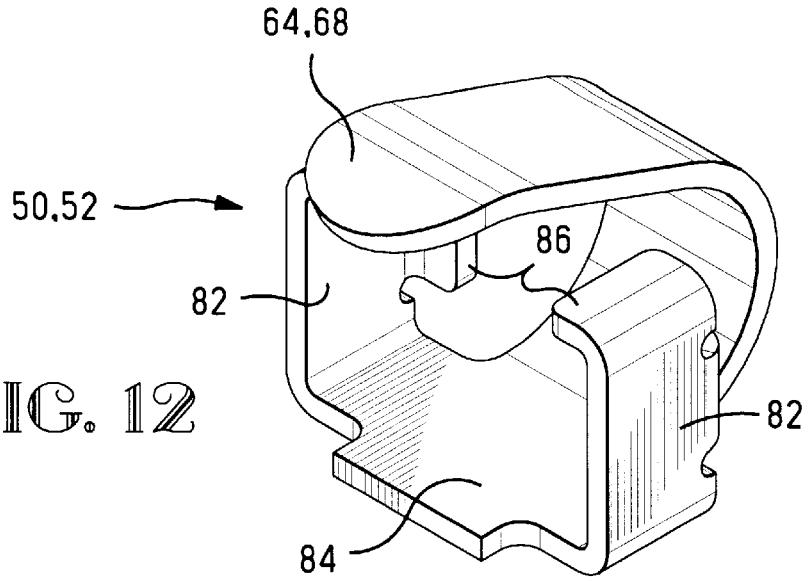
FIG. 12 is an isometric view of a contact of the adapter assembly.
Figure 13:
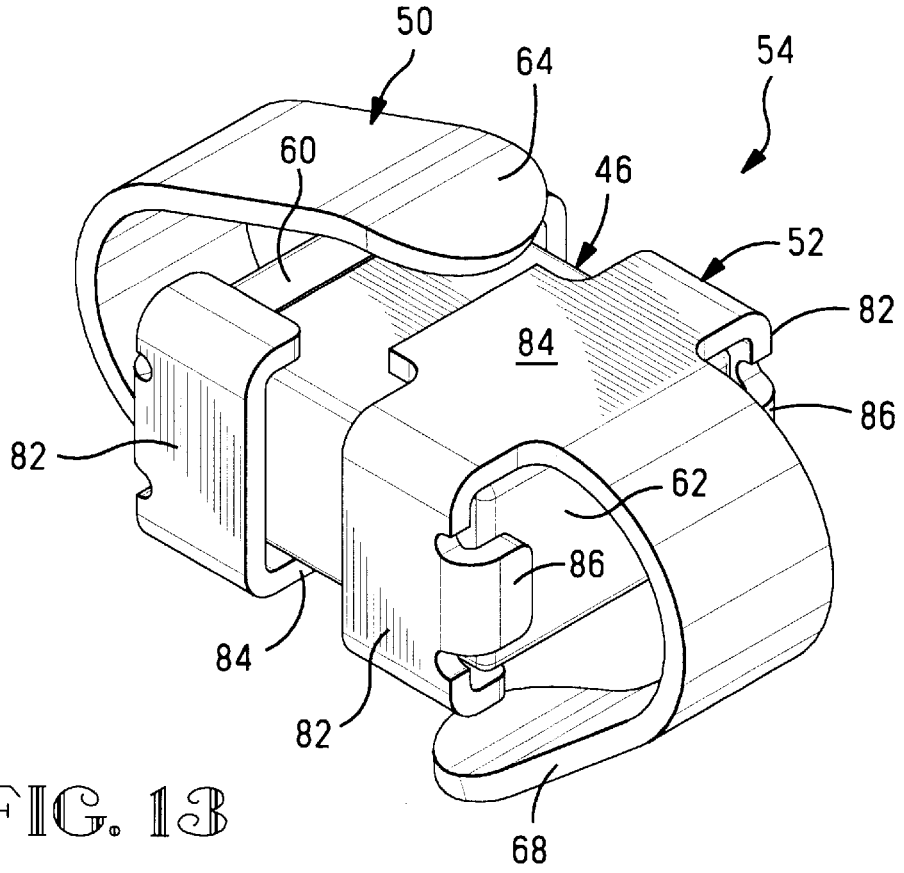
FIG. 13 is an isometric view of a capacitor assembled within a pair of contacts of FIG. 12.

Referring now to FIGS. 12 and 13, each contact includes opposed wall sections 82 extending from a body section 84, and end tabs 86 that extend toward each other from the opposed wall sections 82. Opposed wall sections 82 extend along sides of a capacitor 46 when the contact is fitted onto an end of the capacitor, and end tabs 86 extend along end surfaces of a respective capacitor electrode 60,62. Preferably, side surfaces of the electrodes are soldered to wall sections 82 and to body section 84, and end tabs 86 soldered to the electrode end surfaces.

Figure 14:
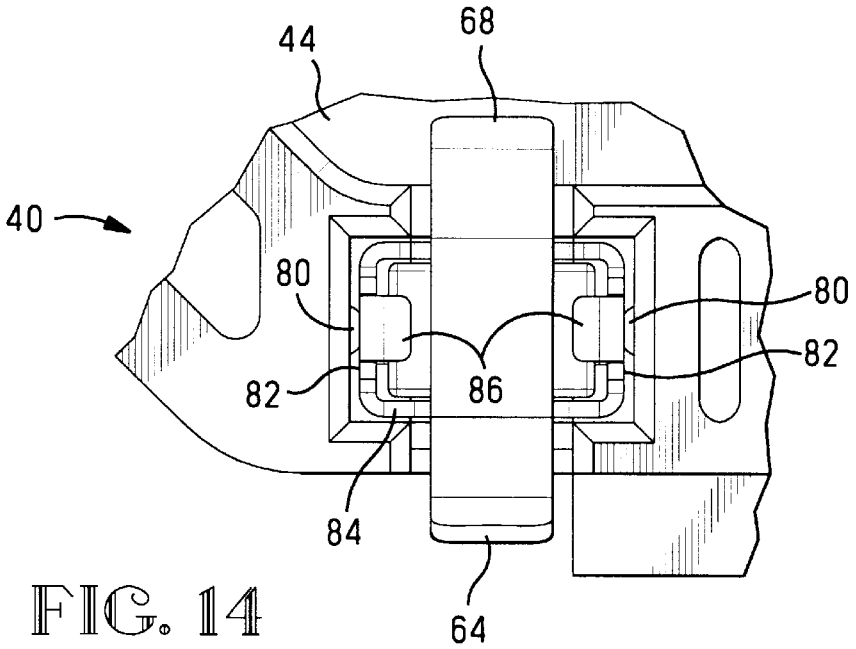
FIG. 14 is an enlarged view of a portion of the adapter assembly showing a capacitor and contacts assembled in position.

As seen in FIGS. 10 and 14, along opposed side walls of each seat 48 of housing 42 are rounded embossments 80 that are engaged and resiliently compressed by opposed wall sections 82 of each contact 50,52 upon insertion of the subassembly 54 into its seat 48, providing retention of the capacitive subassembly 54 in seat 48.

Figure 15:
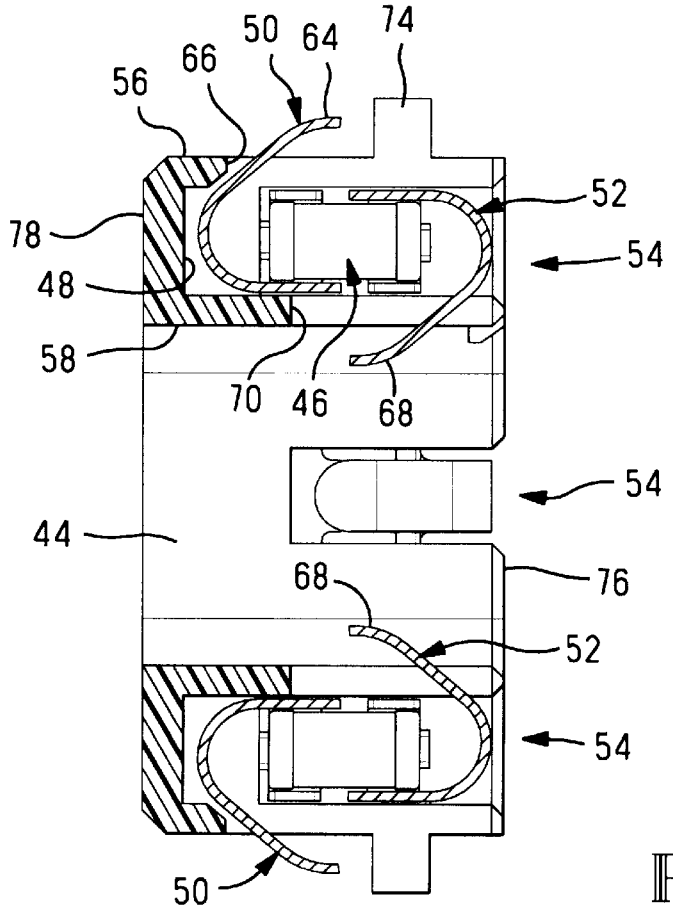
FIG. 15 is a longitudinal cross-section of the adapter assembly of FIGS. 9 and 11.
Figure 16:
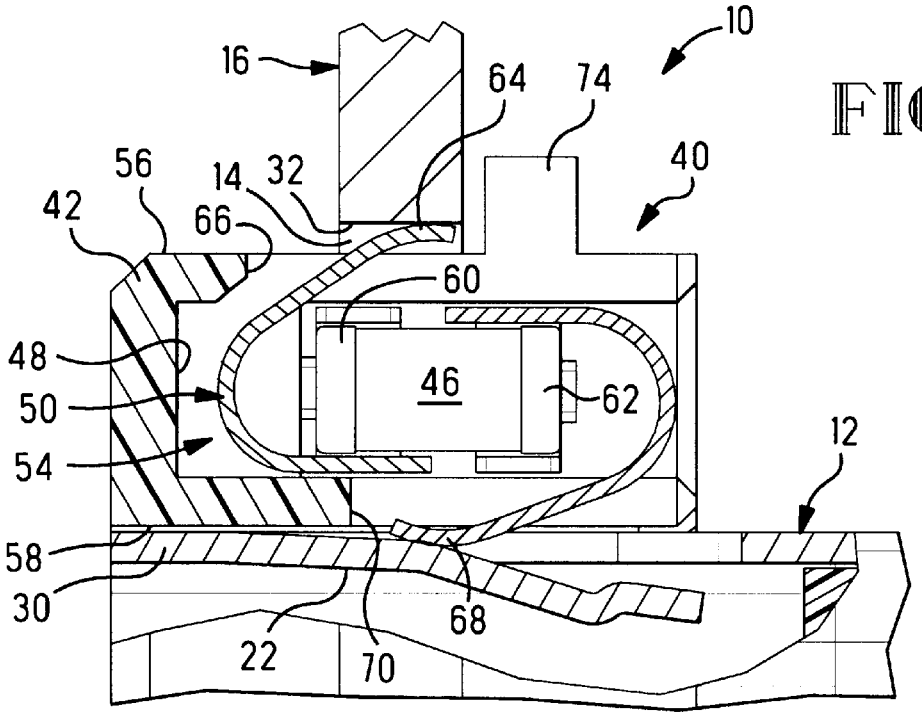
FIG. 16 is an enlarged cross-sectional view of the adapter showing a capacitor and contacts associated therewith in engagement with a shell of the connector of FIGS. 1 to 4 and the panel of FIG. 1.

In FIG. 15 can be seen a subassembly 54 prior to mounting of a connector in aperture 44, with spring arm 68 protruding into aperture 44 and spring arm 64 protruding outwardly from adapter 40. In FIG. 16 is seen a subassembly 54 after a connector 12 has been inserted through aperture 44 and after assembly 10 has then been inserted through a panel cutout 14: spring arm 68 is now engaged with and biased against connector shell 22, and spring arm 64 is engaged with and biased against edge surface 32 of cutout 14 of panel 16, thus capacitively coupling the panel and the connector shell.

Figure 17:
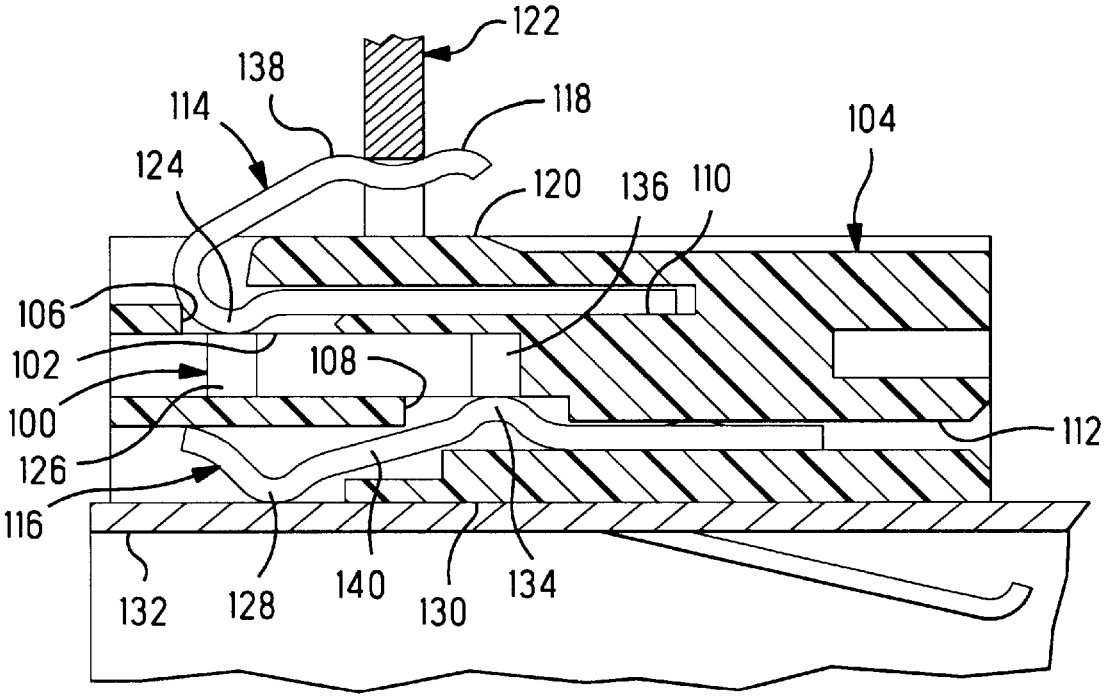
FIG. 17 is a cross-sectional view similar to FIG. 16 of an alternate embodiment of capacitive subassembly.
Figure 18:
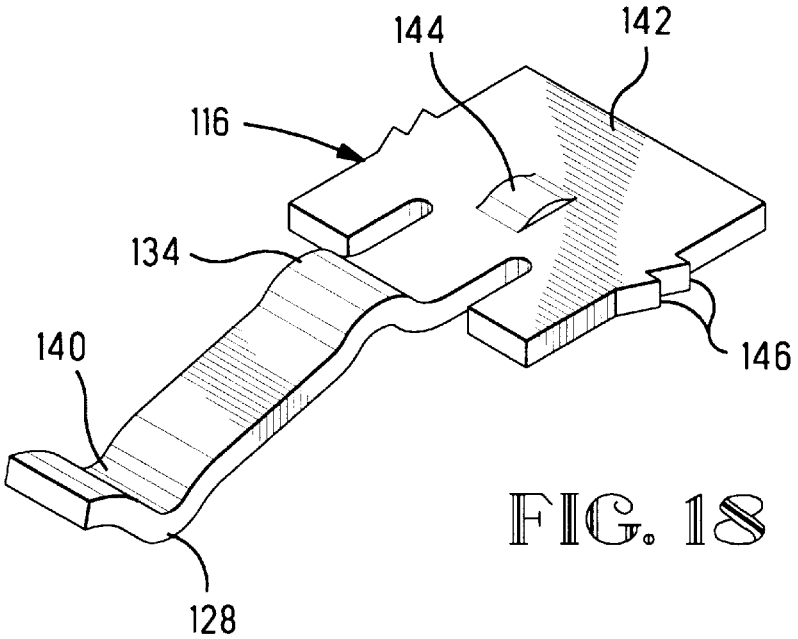
FIG. 18 is an isometric view of one of the contacts of the subassembly of FIG. 17.

Another capacitive subassembly embodiment is illustrated in FIGS. 17 and 18. Capacitor 100 is insertable into a seat 102 of housing 104. Openings 106,108 provide communication with adjacent first and second slots 110,112 into which are inserted first and second contacts 114,116. First contact 114 includes a first contact section 118 that extends outwardly beyond outer housing surface 120 to engage panel 122, and also includes third contact section 124 that extends through opening 106 to engage first electrode 126 of capacitor 100. Second contact 116 includes a second contact section 128 that extends inwardly into connector receiving aperture 130 to engage connector shell 132, and also includes fourth contact section 134 that extends through opening 108 to engage second electrode 136 of the capacitor. The first and third contact sections are seen to be defined on a common spring arm 138, and the second and fourth contact sections are defined on a common spring arm 140. Each contact may have a generally planar body section such as body section 142 of second contact 116, with a biasing embossment 144 and retention barbs 146 along opposed edges thereof for retention in the respective one of slots 110,112 of the housing. The embodiment of FIGS. 17 and 18 eliminate the need for soldering of the contacts to the capacitor electrodes.

Figure 19:
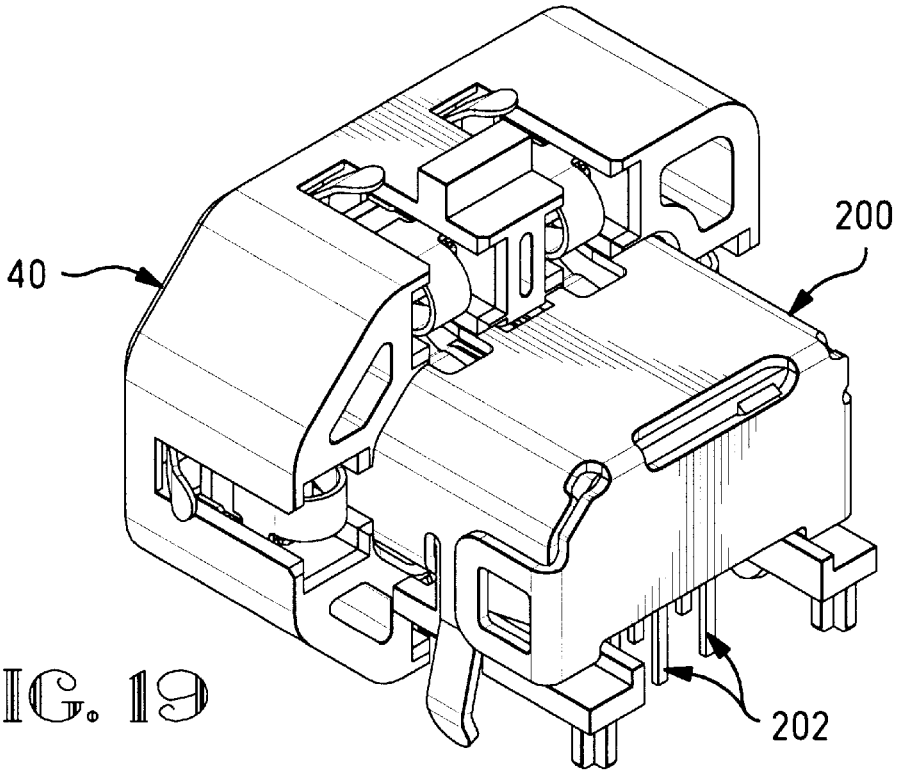
FIG. 19 is a rear isometric view of the capacitive coupling adapter assembled to a connector that is adapted for through-hole mounting to a circuit board.

Adapter 40 may be utilized with other connectors, such as connector 200 shown in FIG. 19. Connector 200 is seen to include contacts 202 that depend beneath the board-mounting face of the connector for insertion into through-holes of a board, instead of being surface mounted to a board as in connector 12 of FIGS. 1 to 16. The capacitive coupling adapter can be easily configured to conform to the cross-sectional outer configuration of other shielded connectors, by modifying the configuration of the connector-receiving aperture.

Other modifications and variations may occur that are within the spirit of the invention and the scope of the claims. For example, means other than the shell-engaging latch and adhesive may be utilized to secure the adapter to the connector. Other styles of contacts may also be utilized than the specific examples illustrated and described herein. Also, other techniques may be adopted for retention of the capacitive subassemblies in the housing.

What is claimed is:

1. An adapter for a shielded electrical connector for capacitively coupling a shield of the connector to a conductive panel within a panel cutout, comprising:

an insulative housing having a connector-receiving aperture therethrough, and at least one seat for retention of a capacitive subassembly therein, and a respective capacitive subassembly disposed in said at least one seat;

each said capacitive subassembly including a capacitor and first and second contacts in electrical engagement with first and second electrodes of said capacitor;

each said seat being in communication with a panel-proximate first surface of said housing and in communication with a connector-proximate second surface of said housing;

each said second contact including a shell-engaging second contact section extending through and beyond said second surface to be engaged and biased by said connector shell when said adapter is mounted over a portion of said connector to define an assembly; and each said first contact including a panel-engaging first contact section extending through said first opening to engage a surface of said panel upon mounting said assembly in the panel cutout, thereby capacitively coupling said panel and said connector shell, the first contact section being biased against the surface of said panel to secure the adapter within the cutout.

2. An adapter as set forth in claim 1 wherein said first and second contact sections are deflectable spring arms.

3. An adapter as set forth in claim 1 wherein said housing is latchable to said connector.

4. An adapter as set forth in claim 1 wherein said first and second contacts are soldered to respective electrodes of said capacitor to define said subassembly.

5. An adapter as set forth in claim 4 wherein each said seat extends to a face of said housing for insertion thereinto of a respective said capacitive subassembly.

6. An adapter as set forth in claim 5 wherein each said seat includes opposed embossments compressible by a respective said capacitive subassembly upon insertion of the subassembly thereinto for retention of the subassembly therein.

7. An adapter as set forth in claim 3 wherein said first and second contacts are identical.

8. An adapter as set forth in claim 1 wherein each said capacitive subassembly includes a capacitor insertable into a respective said seat of said housing, said first contact is insertable into a first slot of said housing such that said first contact section extends beyond said panel-adjacent surface for panel engagement and a third contact section becomes biased against said first electrode of said capacitor, and said second contact is insertable into a second slot of said housing such that said second contact section extends beyond said connector-adjacent surface for shell engagement and a fourth contact section becomes biased against said second electrode of said capacitor.

9. An adapter as set forth in claim 8 wherein each said contact includes a generally planar body section that defines a force-fit within a respective one of said first and second slots upon assembly.

10. An adapter as set forth in claim 8 wherein said first and third contact sections are defined on a common spring arm, and said second and fourth contact sections are defined on a common spring arm.

* * * * *